United States Patent [19]

Madock

[11] Patent Number: 5,022,650

[45] Date of Patent: Jun. 11, 1991

[54] GOLF TOOL

[75] Inventor: Michael F. Madock, River Forest, Ill.

[73] Assignee: KT Products, Inc., LaGrange Park, Ill.

[21] Appl. No.: 512,471

[22] Filed: Apr. 23, 1990

[51] Int. Cl.[5] ..... A63B 57/00; A47L 13/00

[52] U.S. Cl. ..... 273/32 A; 273/32 B; 151/106; 151/160; 172/713

[58] Field of Search ..... 273/32 A, 32 B; 15/105, 15/106, 160; 172/713; D21/234; D4/115, 116, 117, 118

[56] References Cited

U.S. PATENT DOCUMENTS

| | | | |
|---|---|---|---|
| D. 190,333 | 5/1961 | Gunderson | D4/118 |
| D. 191,498 | 10/1961 | Chamberlain et al. | D21/234 |
| 792,471 | 6/1905 | Smith | 15/105 |
| 2,156,668 | 10/1969 | Hedu et al. | D21/234 |
| 2,857,608 | 10/1958 | Schwartz et al. | 15/111 |
| 3,120,388 | 2/1964 | Doble et al. | 273/32 A |
| 3,620,426 | 11/1971 | Hatch et al. | 273/32 A |
| 3,622,157 | 11/1971 | Hatch et al. | 273/32 A |
| 3,763,515 | 10/1973 | Voss et al. | 15/105 |
| 3,866,749 | 2/1975 | Stainer et al. | 273/32 A |
| 4,007,928 | 2/1977 | Doubt et al. | 273/32 A |
| 4,114,878 | 9/1978 | Hammond et al. | 273/32 A |
| 4,315,624 | 2/1982 | Buckman et al. | 273/32 A |
| 4,386,774 | 6/1983 | Buckman et al. | 273/32 A |
| 4,535,987 | 8/1985 | Dikoff et al. | 273/32 A |
| 4,856,132 | 8/1989 | Burns et al. | 7/118 |

*Primary Examiner*—George J. Marlo

*Attorney, Agent, or Firm*—Marshall, O'Toole, Gerstein, Murray & Bicknell

[57] ABSTRACT

A golf tool includes a main body, a pair of tines disposed on a first end of the main body fixed with respect to the main body and a series of bristles forming a brush fixed on a second end of the main body opposite the first end. In addition, a ball marker may be removably mounted on the main body. The golf tool is compact and lightweight and is convenient to use during play.

11 Claims, 1 Drawing Sheet

GOLF TOOL

TECHNICAL FIELD

The present invention relates generally to golf equipment, and more particularly to a tool for use by a golfer.

BACKGROUND ART

Golf is a game that is enjoyed by millions of people around the world. Since each course must accommodate a large number of people, common courtesy and proper golf etiquette dictate that each golfer take steps to maintain the course in proper playing condition. For example, ball marks left when a ball strikes a green should be repaired so that the ball mark does not interfere with subsequent play.

In addition to the foregoing, a ball on a green that is in the lie of another player's ball should be marked and removed from the green so that a clear approach to the hole is provided.

Further, since golf is an outdoor game, mud and debris tend to accumulate on the golfer's shoes and clubs, thereby potentially adversely affecting the golfer's game.

Various tools and equipment have been designed to assist the golfer during play. For example, Hedu U.S. Design Pat. No. 215,668 discloses a golfer combination tool including a forked end for repairing ball marks and a head end into which a V-shaped notch is cut. Projections are formed at ends of the notch and are adapted to engage opposing holes in a collar of a golf shoe cleat. The tool may thus also be used to replace such cleats.

Doble U.S. Pat. No. 3,120,388 discloses a golfing device comprising a main body having a forked end for repairing ball marks and a magnet which retains a ball marker on the body.

Patents similar to Doble disclosing means for mounting a ball marker on a forked ball mark repair tool include Hatch U.S. Pat. No. 3,620,426, Hatch U.S. Pat. No. 3,622,157, Stainer U.S. Pat. No. 3,866,749, Doubt U.S. Pat. No. 4,007,928, Hammond U.S. Pat. No. 4,114,878, Buckman U.S. Pat. No. 4,315,624, Buckman U.S. Pat. No. 4,386,774 and Dikoff U.S. Pat. No. 4,535,987.

Voss U.S. Pat. No. 3,763,515 discloses a combination pocket golf tool including a plurality of cleaning elements carried by a body wherein the distance between adjacent cleaning elements is substantially equal to the distance between adjacent grooves on an associated golf club face. The tool further includes a fork disposed on the end of a flat body that carries the cleaning elements. As noted in column 3, lines 7–11, the fork could be utilized to clean the cleats of golf shoes.

Chamberlain U.S. Pat. No. 191,498 discloses a combined scraper and brush for golf accessories including an elongate body having a tapered scraper at one end thereof and a series of bristles adjacent the scraper.

Schwartz U.S. Pat. No. 2,857,608 discloses a cleaning device for a golf club including a shank on which a blade is carried and a brush intermediate ends of the shank.

Burns et al. U.S. Pat. No. 4,856,132 discloses a utility golf tool including a case, a ball mark repair tool in the form of a blade having a forked end and a series of brush bristles mounted on a spine wherein the spine and the blade are pivotally mounted within the case similar to a pocket knife.

While the golf tools disclosed in the foregoing patents may be effective to assist a golfer during play, it has been found that their usefulness is somewhat limited due to the failure to provide much-needed features in a compact device which can easily be carried by a golfer during play.

In addition to the foregoing patents disclosing golf tools, Battaglia U.S. Design Pat. No. 290,065 discloses a hair grooming device wherein a hair brush is disposed on a first end of a body and a series of picks are disposed on a second end of the body.

SUMMARY OF THE INVENTION

In accordance with the present invention, a golf tool includes a plurality of highly desirable features, yet is small and lightweight so that it can easily be carried by a golfer during play.

More particularly, a golf tool includes a main body, a pair of tines disposed on a first end of the main body and immovable with respect to the main body and a series of bristles forming a brush fixed on a second end of the main body opposite the first end.

In a preferred embodiment of the invention, the main body includes walls defining a recess formed in a face thereof intermediate the first and second ends wherein the recess is adapted to receive a ball marker.

Also in the preferred embodiment, the bristles are arranged in groups on the second end of the main body and are of a length substantially shorter than the length of the main body. Further in the preferred embodiment, the tines are of a length approximately equal to the length of the main body. The tines are tapered to allow for easy insertion into a putting surface in order to repair ball marks.

The golf tool of the present invention is small and lightweight yet provides a number of features which are very useful to a golfer during play.

DESCRIPTION OF THE PREFERRED EMBODIMENT

Figure 1:
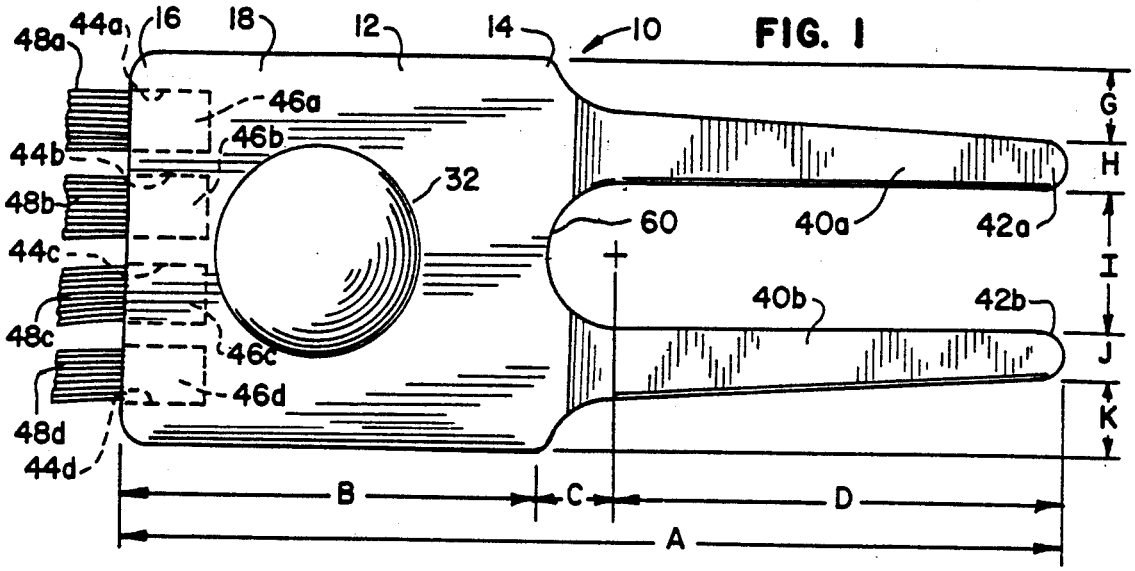
FIG. 1 comprises an elevational view of a first face of the golf tool of the present invention.
Figure 5:
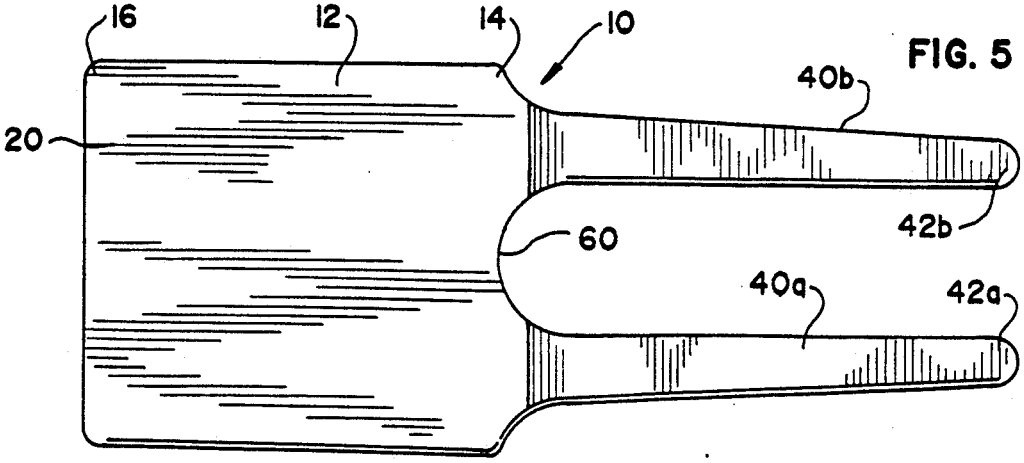
FIG. 5 comprises a elevational view illustrating a second face of the golf tool of FIG. 1 opposite the first face.

Referring to FIGS. 1 and 5, a golf club tool 10 according to the present invention includes a main body 12 having a first end 14 and a second end 16 opposite the first end 14. The main body 12 is rectangular in shape and includes a first face 18 (visible in FIG. 1) and a second face 20 opposite the first face 18 (shown in FIG. 5).

Figure 2:
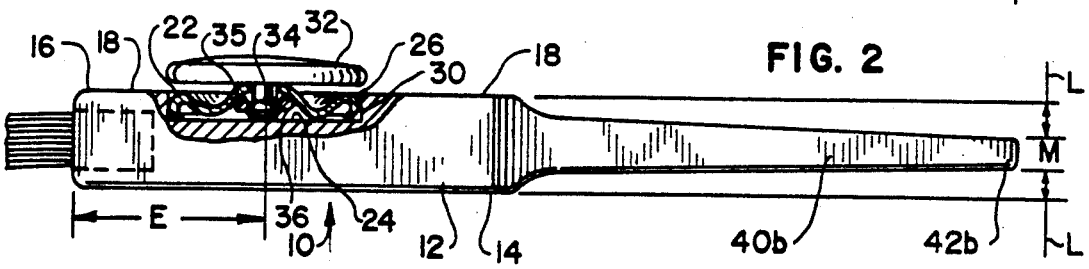
FIG. 2 comprises a side elevational view, partly in section, of the golf tool of FIG. 1.

Referring now to FIGS. 1 and 2, formed in the first face 18 are a side wall 22 and a bottom wall 24 which together define a recess 26. A socket portion 30 forming one-half of a snap fastener is secured by any suitable means, such as adhesive or by press fitting, within the recess 26. A ball marker 32 of conventional design, such as that found on a commercially available golf glove may be placed over the socket portion 30 and be retained in fixed relationship with respect to the main body 12 by pressing the ball marker 32 over the socket portion 30, thereby causing a shouldered stud 34 of the ball marker 32 to engage within a floating spring 35 disposed written a shouldered recess 36 of the socket portion 30. Preferably, at this time the ball marker 32 is disposed sufficiently above the first face 18 to enable a golfer to place an object or his fingernail under the ball marker 32 to remove it from the socket portion 30.

It should be noted that the ball marker 32 could alternatively be retained within or adjacent the recess 26 by a different means, if desired. Also, the recess 26 could be sized to accommodate different types of ball markers, if desired. For example, where a ball marker of the plastic variety having a narrow spike or projection is to be retained on the tool 10, a small hole may be formed in the face 18. The hole could be sized so that the spike or projection is inserted therein and is retained by a friction fit to prevent unintentional separation of the ball marker from the tool 10.

Alternatively, the ball marker may be retained by a magnet, a friction or interference fit with a different portion of the ball marker, or any other suitable securing means.

Disposed on the first end 14 of the main body 12 are a pair of tines 40*a*, 40*b* which, as seen in FIG. 2, are tapered to form relatively sharp points 42*a*, 42*b* at ends thereof. The tines 40*a*, 40*b* are tapered in two dimensions, i.e. from side-to-side and from face-to-face so that the points 42*a*, 42*b* are sufficiently small to permit easy and efficient repair of a ball mark while still leaving enough material to prevent deformation of the tines 40*a*, 40*b* while in use.

Formed in the second end 16 of the main body 12 are walls 44*a*–44*d* forming a plurality of recesses 46*a*–46*d*, respectively. Secured within the recesses 46*a*–46*d* by suitable means, such as adhesive, are a plurality of groups of bristles 48*a*–48*d*. The bristles are made of plastic or another suitable material. The groups of bristles 48*a*–48*d* form a brush which is particularly useful to clean golf equipment, such as golf clubs and golf spikes. Preferably, although not necessarily, the portions of the groups of bristles extending outwardly from the end 16 of the main body 12 are kept short, typically substantially less than the length of the main body 12, so that the golf tool 10 is kept to a relatively short length overall and so that the brush formed by the groups of bristles 48*a*–48*d* will be sufficiently stiff to remove dried and encrusted mud or other debris from the golf equipment.

As seen in FIG. 5, the second face 20 provides an ideal location for printing of indicia, such as a company logo, a message, or the like. Thus, the golf tool can be customized and used as an advertising device or may be customized with the golfer's initials or name, if desired.

The golf tool 10 may be fabricated of aluminum or a different suitable material and the surfaces thereof may be finished by a suitable finishing process, such as by roller burnishing or by coating the surface with paint or a different coating.

Figure 3:
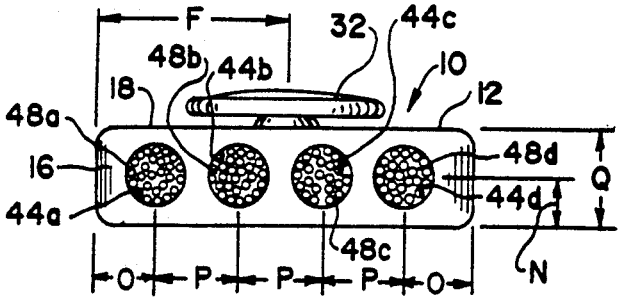
FIG. 3 comprises a first end elevational view of the golf tool of FIG. 1.
Figure 4:
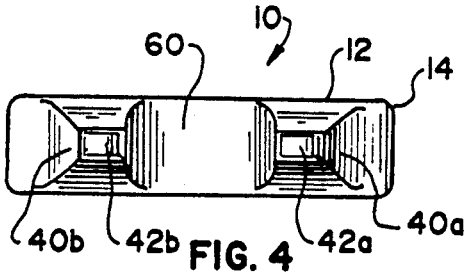
FIG. 4 comprises a second end elevational view of the golf tool of FIG. 1 opposite the first end elevational view of FIG. 3.

In the preferred embodiment, the golf tool 10 is of the dimensions shown below, it being understood that the dimensions are exemplary only and should not be construed as limiting the invention as herein claimed (reference letters indicated below are shown in FIGS. 1–3 and all dimensions are in inches):

| Reference Letter | Dimension |
|---|---|
| A | 2.5 |
| B | 1.0 |
| C | 0.2795 |
| D | 1.2205 |
| E | 0.5 |
| F | 0.5 |
| G | 0.1875 |
| H | 0.125 |
| I | 0.375 |
| J | 0.125 |
| K | 0.1875 |
| L | 0.0781 |
| M | 0.9375 |
| N | 0.125 |
| O | 0.171 |
| P | 0.2187 |
| Q | 0.25 |

In addition to the foregoing, in the preferred embodiment, the diameters of the recesses 46*a*–46*d* are equal to 0.15625 inch and are drilled to a depth of 0.21875 inch, the diameter of the recess 22 is equal to 0.46875 inch and the radius of curvature of a curved portion 60 between the tines 40*a*, 40*b* is equal to 0.275 inch.

In summary, the present golf tool permits a golfer to repair ball marks, to keep a ball marker in a convenient and secure location for easy retrieval and to clean golf equipment. The small size and light weight of the golf tool 10 permits the tool to be carried in a pocket of the golfer for easy retrieval during play.

I claim:

1. A golf tool, comprising:

a main body having first and second opposite ends;

a pair of tines disposed on the first end of the main body and immovable with respect to the main body, the tines extending from the main body in a first direction; and a row of bristles forming a brush for cleaning golf equipment fixed on the second end of the main body opposite the first end, the bristles extending generally from the main body in a second direction 180° opposite the first direction.

2. The golf tool of claim 1, wherein the main body includes walls defining a recess formed in a face thereof intermediate the first and second ends wherein the recess is adapted to receive a ball marker.

3. The golf tool of claim 1, wherein the bristles are arranged in groups on the second end of the main body.

4. The golf tool of claim 1, wherein the main body is of a certain length and wherein the bristles are of a length substantially shorter than the certain length.

5. The golf tool of claim 1, wherein the main body is of a certain length and wherein the tines are of a length approximately equal to the certain length.

6. A golf tool, comprising:

a main body having first and second substantially flat, parallel opposed faces separated by a certain thickness and terminating at first and second opposite ends and walls disposed in one of the flat faces defining a recess adapted to receive a ball marker;

a fork comprising a pair of tines disposed on the first end of the main body, the tines extending away from the main body along a first direction and each having a pair of faces separated from one another by a maximum thickness no greater than the certain thickness; and a brush for cleaning golf equipment comprising a row of bristles disposed on the second end of the main body, the bristles extending away from the main body along a second direction 180° opposite to the first direction.

7. The golf tool of claim 6, wherein the bristles are arranged in groups on the second end of the main body.

8. The golf tool of claim 6, wherein the main body is of a certain length and wherein the bristles are of a length substantially shorter than the certain length.

9. The golf tool of claim 6, wherein the main body is of a certain length and wherein the tines are of a length approximately equal to the certain length.

10. A golf tool, comprising:

a main body of a certain length having a first end, a second end opposite the first end and walls defining a recess intermediate the first and second ends;

means disposed in the recess for retaining a ball marker in fixed relationship with respect to the main body;

a fork comprising a pair of tines disposed on the first end of the main body and immovable with respect to the main body, the tines extending in a first direction away from the main body; and a row of bristles arranged in groups to form a brush for cleaining golf equipment disposed on the second end of the main body, the bristles extending in a second direction 180° opposite to the first direction;

wherein the bristles are of a length substantially shorter than the certain length and the tines are of lengths approximately equal to the certain length.

11. The golf tool of claim 10, wherein the brush is fixed with respect to the main body.

* * * * *